US008734078B2

(12) United States Patent
Benedict et al.

(10) Patent No.: US 8,734,078 B2
(45) Date of Patent: May 27, 2014

(54) AUTOMATED AUTOMOTIVE VEHICLE PARKING/STORAGE SYSTEM

(75) Inventors: Charles E. Benedict, Tallahassee, FL (US); Brian G. Pfeifer, Tallahassee, FL (US); Christian A. Yates, Tallhassee, FL (US); Scott K. Bladen, Bristol, FL (US); Richard E. Lackinger, Tallahassee, FL (US); James R. Dobbs, Tallahassee, FL (US)

(73) Assignee: BEC Companies Inc., Tallahassee, FL (US)

( * ) Notice: Subject to any disclaimer, the term of this patent is extended or adjusted under 35 U.S.C. 154(b) by 0 days.

(21) Appl. No.: 12/855,017

(22) Filed: Aug. 12, 2010

(65) Prior Publication Data

US 2012/0039693 A1 Feb. 16, 2012

(51) Int. Cl.
*E04H 6/22* (2006.01)

(52) U.S. Cl.
USPC ..... 414/239; 414/241

(58) Field of Classification Search
CPC ..... E04H 6/22; E04H 6/225; E04H 6/24; E04H 6/245
USPC ..... 414/239–240, 241, 246, 264, 279; 187/270
See application file for complete search history.

(56) References Cited

U.S. PATENT DOCUMENTS

| | | | | |
|---|---|---|---|---|
| 3,804,208 | A * | 4/1974 | Iida | 187/270 |
| 4,312,623 | A * | 1/1982 | Allred et al. | 414/807 |
| 5,669,753 | A * | 9/1997 | Schween | 414/800 |
| 6,851,921 | B2 * | 2/2005 | Haag | 414/800 |
| 7,101,139 | B1 * | 9/2006 | Benedict | 414/281 |
| 7,381,022 | B1 * | 6/2008 | King | 414/267 |
| 2007/0065258 | A1 * | 3/2007 | Benedict et al. | 414/266 |

FOREIGN PATENT DOCUMENTS

EP 314837 A1 * 5/1989

* cited by examiner

*Primary Examiner* — Jonathan Snelting
(74) *Attorney, Agent, or Firm* — Dowell & Dowell, PC

(57) ABSTRACT

A system and method for optimizing the parking and storage capacity of a vehicle parking garage wherein rows of vertical columns of parking spaces or cubicles are spaced in opposing relationship with one another such that at least one automatic guided and self propelled vehicle (AGV), with or without a vehicle support tray mounted thereon, is vertically movable in engagement with the opposing racks or chains that extend on opposite sides of the vertical columns of parking cubicles so that a vehicle may be loaded onto the AGV and thereafter transferred to, and later removed from a parking cubicles and transferred to an exit of the garage. If tray are used on the AGV, additional trays are stored in storage spaces adjacent each parking cubicle.

12 Claims, 14 Drawing Sheets

AUTOMATED AUTOMOTIVE VEHICLE PARKING/STORAGE SYSTEM

BACKGROUND OF THE INVENTION

1. Field of the Invention

This application is directed to the general field of parking garages for automotive vehicles and more particularly to automated vehicle parking garages and/or storage systems wherein vertical stacks or columns of vehicle storage cubicles are laid out in generally parallel rows that are generally equally spaced by aisles that are of generally equal width and of a size to permit one or more automatically guided vehicles (AGVs) to move both horizontally and vertically between the rows of storage cubicles.

2. Brief Description of the Related Art

Adequate automotive vehicle parking spaces and short and long term storage spaces for such vehicles is an ever growing problem in most major cities in the world. Further, the parking problems are not limited to cities, but often to public transit areas such as airports, docking terminals, railway stations and the like as well as to commercial and entertainment facilities such as shopping malls, sports and concert complexes and the like.

Conventional parking garages are constructed in such a manner that each vehicle is driven from a garage entrance to an open parking space either by the driver or by a attendant who works for the garage facility. In either case, the effective parking space is limited for each footprint of garage surface area as there is a lot of "dead space" in conventional garages that can not be used for parking. Such "dead space' includes ramps that must be provided between each level of the parking facility and aisles or driving lanes that must be provided between oppositely oriented parking spaces to permit vehicles to drive between the spaces and to turn and maneuver into the parking spaces. With the ever increasing costs of real estate, there must be improvements made to maximize the parking capability of parking garages.

In an attempt to mitigate against some of the problems associated with conventional parking garages, a variety of automated garages have been proposed to enhance the parking of automotive vehicles. Some enhancements have developed continuous chain systems that support a plurality of parking platforms on which vehicles may be supported. The continuous chain systems allow vehicles to be stored in vertical rows in close horizontal relationship relative to one another but are not practically functional as the retrieval of one vehicle from the system may require that substantially the entire length of the continuous chain may have to be moved relative to a discharge area in order to allow a particular vehicle to be removed from the parking system.

In other newer automated parking garages, vehicles entering the garage are initially driven onto a platform that moves the vehicle into alignment with a transport device, such as a horizontally movable elevator. The vehicle must be transferred from the platform to the elevator so that the elevator may raise the vehicle until it is aligned with a parking bin. Once aligned, the vehicle is off loaded. Such multiple transfers of a vehicle from one movement unit to another results in an inefficient and time ineffective manner in which to park vehicles in a parking facility. Also, with such automated systems, the vehicles are transferred into the parking bins in a lengthwise direction, thus requiring a transfer distance of up to twenty-five feet or more in order to place a vehicle in a parking bin.

In light of the foregoing, there remains a need to provide a more efficient and cost effective automated vehicle parking system that increases the number of parking spaces for a given land footprint for a parking garage and wherein vehicles entering and leaving the garage are handled using a minimum number of vehicle handling equipment.

SUMMARY OF THE INVENTION

An automated automotive vehicle parking garage and/or vehicle storage system that includes vertical stacks or columns of vehicle storage cubicles that are laid out in generally parallel rows that are generally equally spaced by aisles that are of generally equal width and of a size to permit one or more automatically guided vehicles (AGVs) to move both horizontally and vertically between the rows of storage cubicles. In the preferred embodiments, the AGVs are independently movable and have sets of drive sprockets or gears that permit the vehicles to ascend and descend the vertical stacks of cubicles by engaging with teeth or chain or gear rack elements that are disposed on opposite sides of each of the opposing vertical stacks or columns of parking cubicles.

In the preferred embodiments, the AGVs are provided with vehicle supporting trays onto which vehicles are directly driven as a vehicle enters the parking facility. When not in use, the trays may be stored in storage cells located either above or below the vertical stack or tiers of parking cubicles. Each vehicle support tray includes a platform support on support castors or wheels that allow the trays to be easily maneuvered relative to an upper surface of an AGV and the floor portion of a parking cubicle. Each tray preferably includes at least one wheel well in which at least one, and preferably both, of either the front or rear wheels of a vehicle are seated when driven onto the tray and which wells prevent the accidental movement of a vehicle from the tray. In some embodiments several spaced wheel retaining wells may be provided on the vehicle support trays. Other vehicle locking mechanisms may also be provided to secure vehicles to the support trays that are manipulated by the AGVs.

Each AGV also includes a self-loading and off-loading tray transfer mechanism that is operative to either pull trays supporting vehicles from a parking cubicle or move trays supporting vehicles into the parking cubicles. The same transfer mechanism is also used to load an empty tray onto the AGV or remove a tray and store it in a storage space below or above one of the parking cubicles.

The present invention is also directed to a fully automated parking system wherein the AGVs are driven horizontally by on-board motors, which, in the preferred embodiments are DC electric motors that receive power from rechargeable on-board batteries while the vertical movement of the AGVs is driven by AC motors which receive their power from electric AC raceways provided along vertical columns provided on opposite sides of each of the vertical tiers of parking cubicles. The rows of vertically tiered parking cubicles are spaced apart a distance substantially equal to either a width of the AGVs, in a first embodiment, or a length of the AGVs, in a second embodiment, so that guide elements or drive mechanisms mounted on the AGVs cooperatively engage either guide tracks or teeth/chain elements mounted on opposite sides of each vertical stack or column of parking cubicles. In the second embodiment, in some instances it may preferred to load and off load vehicles directly from an upper surface of the AGVs as the vehicles may be placed in a neutral gear and pushed into or pulled from a parking cubicle.

To permit independent vertical drive of the AGVs, vertical racks or chains including spaced teeth or rollers are mounted to extend along opposite sides of each of the parking cubicles in a vertical stack. Each AGV is provided with oppositely oriented drive gears or sprockets that are engageable with the teeth of the vertical racks or rollers of the chains. The drive motors carried by each AGV are controlled to rotate each of the gears or sprockets at uniform velocities and in opposite directions on opposite sides, or ends, of each AGV.

For security purposes and to provided for maximum vehicle storage for a given footprint of ground space for a given parking facility, the vehicle parking cubicles are preferably oriented parallel to the rows between the vertical tiers of cubicles such that vehicles are stored parallel to the ingress and egress rows traveled by the AGVs. This also facilitates transfer of the vehicles from the AGVs to the parking cubicles as the vehicles need only to be shifted generally seven to eight feet during off-loading for parking or on-loading for retrieval of vehicles. In a second embodiment of the invention, however, the cubicles are configured so as to receive the AGVs lengthwise, from end to end. In this embodiment, the aisles between the vertical tiers of cubicles are thus of a width substantially equal to the length of the AGVs.

Each of the parking cubicles may include a lock or blocking mechanism that either engages with a vehicle support tray within a cubicle or which obstructs movement of a tray from a cubicle unless an AGV is aligned to retrieve a tray from the cubicle.

In some embodiments of the invention, power to AGVs and the loading and off-loading transfer mechanisms and the motors for the drive gears may be provided by on board batteries, although, as set forth above, AC power is preferred, under normal operating conditions.

One of the advantages of the parking system of the invention is that parking space in maximized within any facility due to the fact that the amount of aisle space required is limited to the depth of the parking spaces or cubicles that are necessary to accept or receive the vehicle support trays, which space is essentially equal to a width or length of the largest vehicle to be parked within the parking facility. No additional space is required between the opposing parking cubicles to provide for the turning and maneuvering of the AGVs.

To further maximize storage space, the vertical guide racks or tracks are preferably inset relative to the outer face of the parking cubicles such that the guide rollers, wheels or drive gears or sprockets extending from the opposite sides or ends of the AGVs are seated therein such that the side walls of the AGVs are closely spaced relative to the outer faces of the parking cubicles.

To facilitate positioning of the vehicles so they are pointed toward the exit for leaving the garage, the AGVs may be omnidirectional being provided with the ability to rotate up to as great as 360 degrees about their vertical centerline whenever the entrance and exit to the parking garage are located at the same end of the garage structure. When the entrance and exit to the garage are at opposite ends of the garage the AGVs are not required to rotate.

It is an object of the invention to allow multiple AGVs to operate simultaneously within a parking facility and wherein vehicles entering a garage are directly driven onto the AGVs or vehicle support trays carried by the AGVs such that no additional transfer or vehicle orienting equipment is necessary to maneuver vehicles from an entrance to the garage to any of the vertically tiered parking cubicles.

It is another object of the present invention to provide a parking garage that maximizes parking space by reducing the size of aisles, drive paths and other areas of non-parking space by using a plurality of vertical columns of parking cubicles wherein the depth of the cubicles is substantially equal to either the width or length of AGVs which transport the vehicles to be parked and width of the aisles.

It is a further object of the invention to provide AGVs that may be self-powered by on board batteries or powered from raceways or inductive power transfer (IPT) channels when being maneuvered horizontally and vertically relative to columns of parking cubicles and wherein such AGVs include drive gears or sprockets and the like for engaging pairs of oppositely facing toothed racks or chain-like elements that are provided on opposite sides of each column of parking cubicles.

It is yet another object of the invention to provide a vehicle parking system wherein vehicle support trays carried by the AGVs are automatically loaded and off-loaded relative to vertically spaced parking cubicles by transfer devices carried by the AGVs.

It is also an object of the invention to provide tray storage below or above each parking cubicle to decrease tray transfer time from tray storage stacks.

BRIEF DESCRIPTION OF THE DRAWINGS

A better understanding of the invention will be had with reference to the accompanying drawings wherein.

DESCRIPTION OF THE PREFERRED EMBODIMENT

Figure 1:
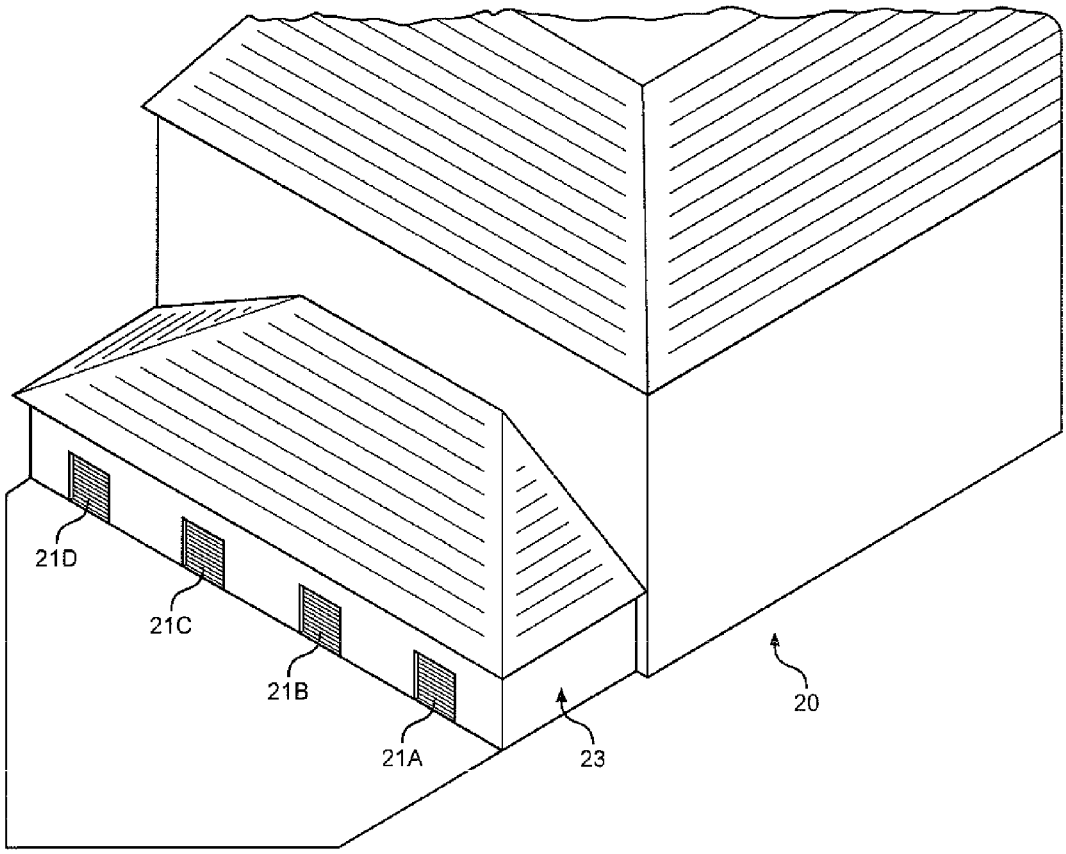
FIG. 1 is a perspective illustration view of a parking garage in accordance with the invention showing vehicle entry and exit doors.

With continued reference to the drawings, a high occupancy and fully automated parking garage system 20 is disclosed that includes a plurality of entrance and/or exit doors 21A, 21B, 21C and 21D into spaced loading and off-loading bays 22A-22D within a first portion 23 of the system 20. Within each bay is a recessed docking surface shown at 24A, 24B and 24C. The depth of each recessed docking surface is sufficient to allow an automated guided vehicle (AGV) 25, see FIG. 3, carrying a vehicle support tray 26 to be parked within the docking surface such that a conventional automotive vehicle "V" may be directly driven onto the support tray when entering the bay areas of the garage, see FIG. 3, or from the support tray to a travel surface "S" when a vehicle is exiting the garage system, see FIG. 4.

The parking garage includes a plurality of rows 28 of vertical columns of back-to-back parking cubicles 30. To optimize the storage capacity of the area in which the system 20 is to be used, the aisles "I" between the rows of parking cubicles is created having essentially the same width "W" as the depth "D" of each of the parking cubicles. Unlike conventional automated parking systems that require space for maneuvering vehicles between the rows of parking cubicles, with the present invention, the trays 26 on which vehicles are supported are carried by the automatically guided vehicles (AGV) 25 in such a manner that the AGV maneuvers the vehicles into proper position before the AGV enters an aisle between rows of parking cubicles.

Figure 3:
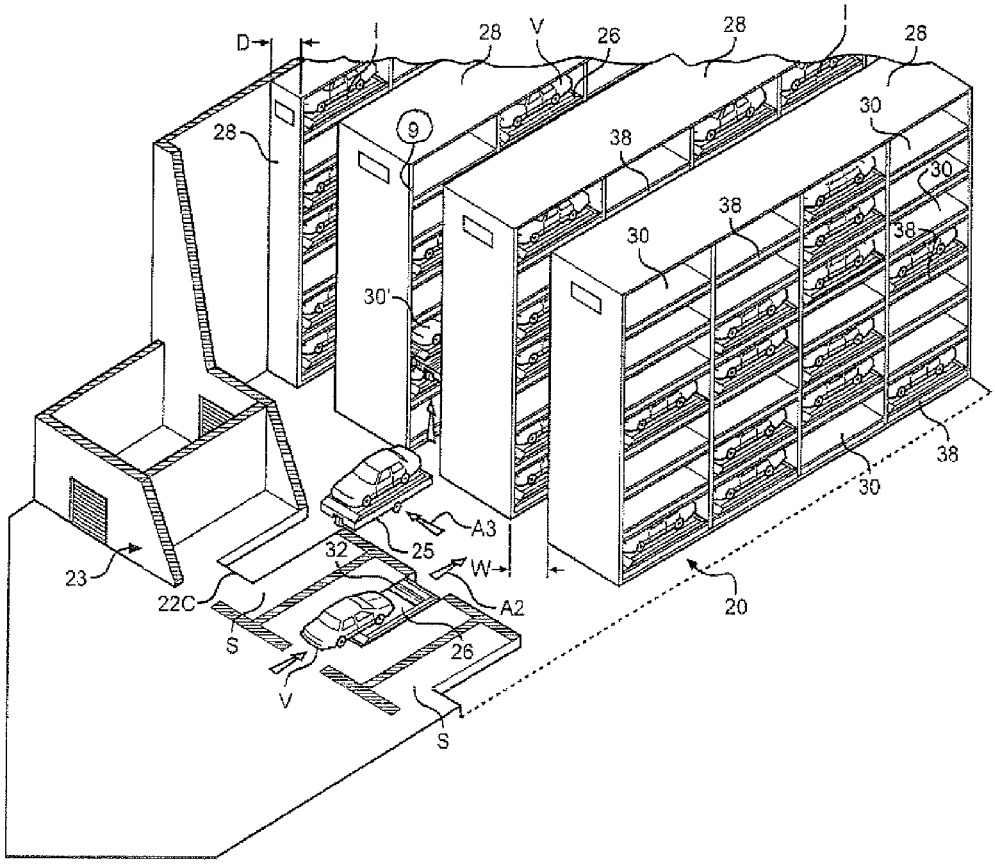
FIG. 3 is a perspective illustration similar to FIG. 2 but showing an automatic guided vehicle (AGV) moving in sequence from a loading position adjacent an entry door into the garage, rotated to face the exit position to a position aligned with a drive path between opposing rows of vertical tiers of parking cubicles and elevated to a position and transferring the vehicle into one of the parking cubicles.
Figure 4:
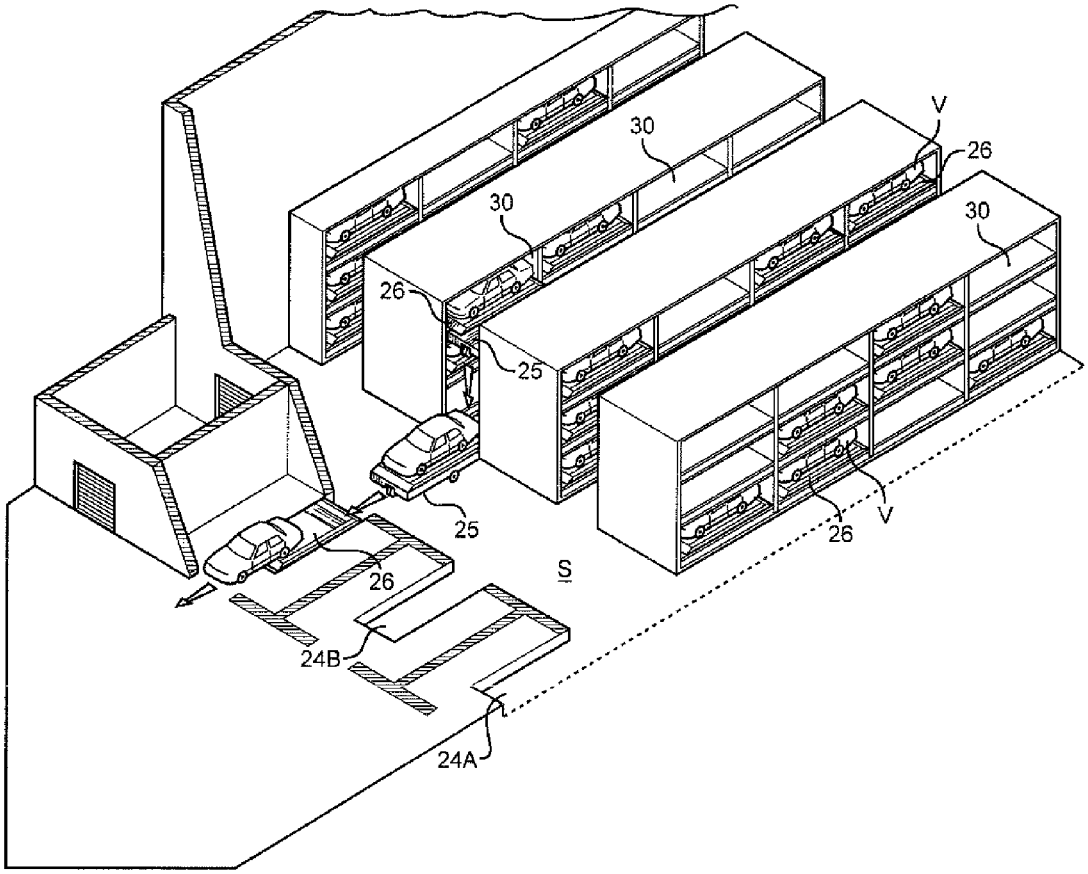
FIG. 4 is a perspective illustrational view similar to FIG. 3 but showing the automatic guide vehicle (AGV) moving in sequence from a loading position adjacent one of the parking cubicles where a vehicle is loaded onto the AGV, to a position aligned with a drive path between opposing rows of vertical tiers of parking cubicles and moved horizontally within the garage to an exit of the garage.
Figure 6:
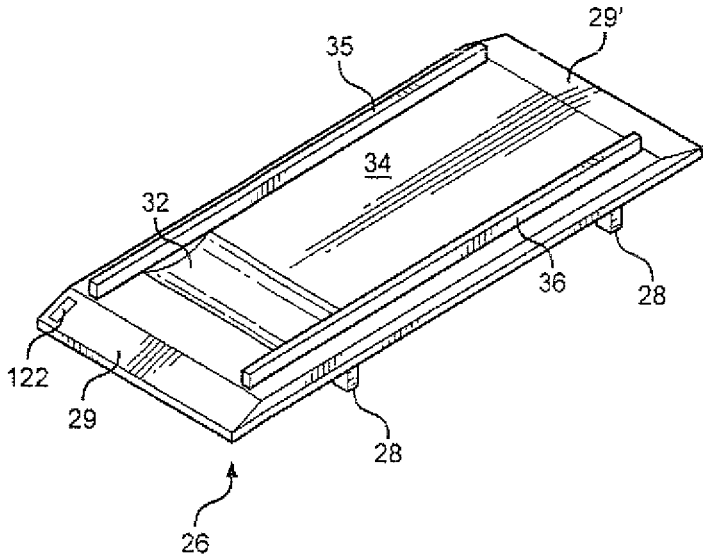
FIG. 6 is a top perspective view of one of the vehicle support trays of the invention.
Figure 7:
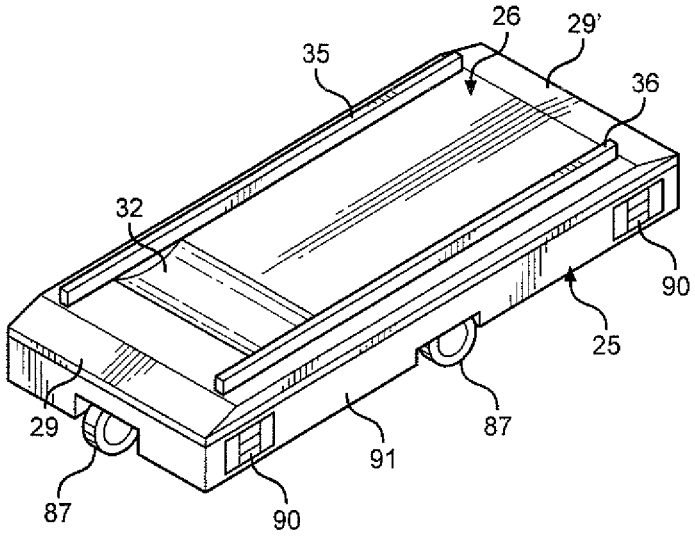
FIG. 7 is a perspective view of the tray of FIG. 6 carried on the AGV of FIG. 5.

With reference to FIGS. 3 and 4, as a vehicle "V" enters the garage and into bay 22B wherein an AGV 25 having a vehicle support tray 26 mounted thereon is parked in recessed docking surface area 24B, the vehicle is directly driven onto the tray 26 until the front wheels of the vehicle are received in a somewhat U-shaped cradle 32 that is formed in an upper surface 34 of the tray, see FIGS. 6 and 7. Elongated vertically extending wheel guide flanges 35 and 36 are secured to the upper surface of the tray and are spaced apart a distance to permit the vehicle wheels to be received there between. Although not shown, the outer portions of the flanges 35 and 36 may be flared outwardly so as to function as guide surfaces for properly orienting the steerable front wheels of the vehicle onto the upper surface of the tray. When the front wheels of a vehicle enter the cradle 32, the vehicle is stopped and retained securely within the tray and on the AGV as the wheels can not be easily rolled out of the cradle and the side flanges 35 and 36 prevent any lateral movement of the vehicle relative to the tray 26. As shown, each tray 26 is support by plurality of swivel castors or wheels 28 and include front and rear ramps 29 and 29'.

After being loaded onto the tray and AGV, the AGV moves into the parking garage as shown by arrow A2 and the AGV moves laterally as shown by the arrow A3 to align with an aisle "I" between opposing rows 28 of vertically tiered parking cubicles 30. Any orienting of the vehicle "V" such as rotating 180 degrees to position a the vehicle "V" toward the exit direction is performed by the AGV without any other assistance. Thereafter, the AGV enters the row and elevates itself, as will be described later herein, until the vehicle aligns with a particular cubicle 30'. The tray 26 carrying the vehicle is then urged from the AGV into the aligned cubicle 30'.

A feature of the present invention is that each AGV in a system, and there will be numerous AGVs depending on the capacity of the garage, will at all times have a tray thereon which is ready to receive a vehicle. To accomplish this, additional trays 26 are mounted in some of the spaces 38 below each parking cubicle. Once a vehicle and supporting tray have been transferred into a parking cubicle, the AGV retrieves the extra tray from the adjacent space 38 and travels back to the loading area at one of the entrances into the garage. If the AGV is directed to retrieve a vehicle from a parking cubicle before it loads another vehicle on the newly loaded tray, the AGV will move to the appropriate parking cubicle and first off-load the tray carried thereon into the empty tray retaining space 38 below the parking cubicle 30. The space 38 will be vacant as the tray that was previously therein would have been removed by the AGV that initially loaded or transferred the vehicle and tray to be retrieved. By way of example, if there are eight hundred (800) parking cubicles in a garage and sixteen (16) AGVs in the system, there will be a total of eight hundred and sixteen (816) trays in the system. As shown in FIG. 3, a height and configuration of the tray storage spaces 38 is sufficient to store a vehicle support tray therein and the height is much smaller than a height of the parking cubicles 30.

As shown in FIGS. 3 and 4, the AGVs 25 are designed to move both horizontally along the drive surface of the garage and vertically between opposing columns of the parking cubicles 30 under their own power. The AGVs are movable horizontally along a support surface using omni-directional drive wheels 87, see FIG. 5. In this manner the AGVs may be driven in any direction and rotated in the manner of a turntable. As opposed to the use of four drive wheels shown in the drawing figures, the AGVs may be support on four sets of castors or rollers and be provided with a centered omni-directional drive wheel or roller. The drive wheels 87 are driven by on-board electric motors, not shown, that are powered by DC power received from on-board batteries and vertically by AC motors powered by raceways positioned along the vertical supports on either side of the vertical tiers of parking cubicles.

Figure 5:
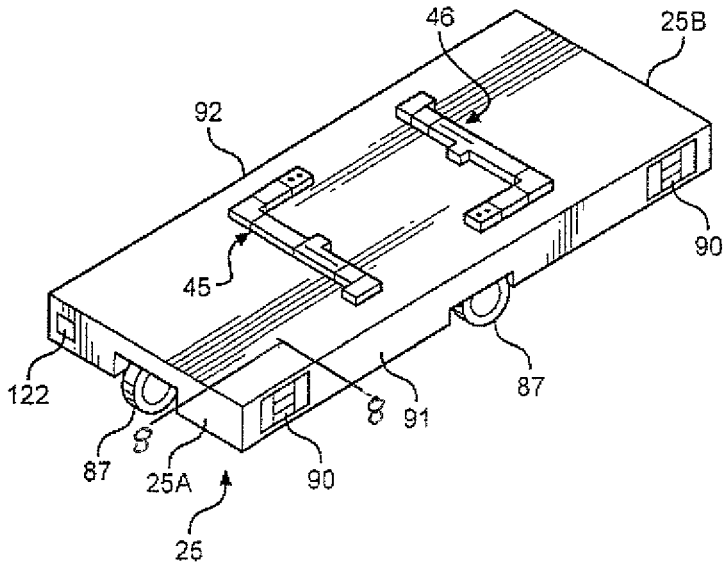
FIG. 5 is a top perspective view of one of the automatically guided vehicles (AGVs) of the invention.

To move vertically between the columns of parking cubicles, each AGVs 25 is provided with at least two drive sprockets 90 that are extendable outwardly from the opposite sides 91 and 92 thereof. In the embodiment shown, four drive sprockets extend outwardly from each of the opposite sides and adjacent each of the ends of the of the AGV, see FIG. 5. Note only one side is fully shown in FIG. 5. In FIG. 5 the drive sprockets 90 are shown withdrawn into the framework of the AGV adjacent each of the four corners thereof.

Figure 8:
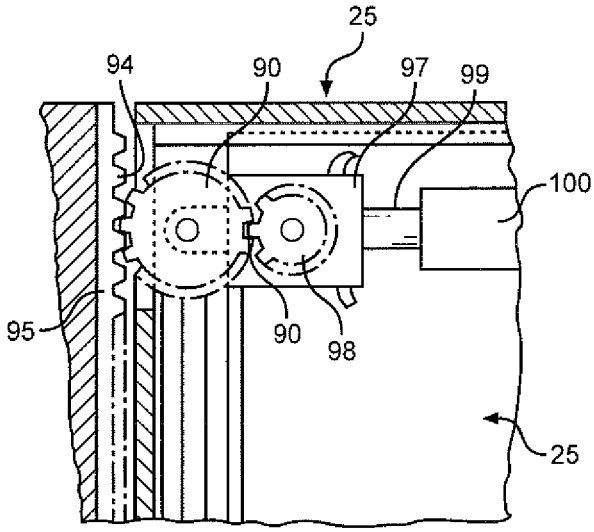
FIG. 8 is a partial cross sectional view of a corner portion of and AGV taken along lines 8-8 of FIG. 5 and further illustrating how one of the on-board drive sprockets for raising and lowering an AGV under its own power engages teeth of racks or chains, see FIG. 9, provided on the front portions and on opposite sides of the vertical columns of parking cubicles.
Figure 9:
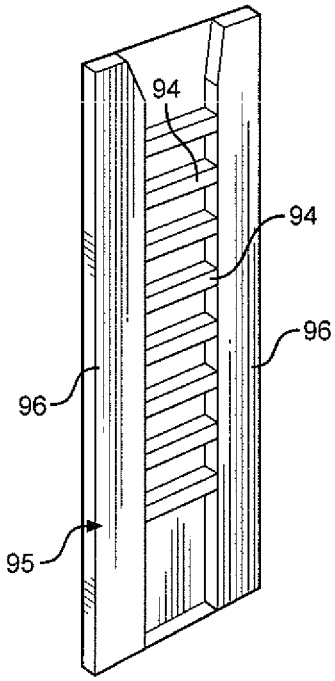
FIG. 9 is a blow up of a section of vertical rack or track circled at 9 in FIG. 3 which is a portion of the racks provided on opposite sides of each of the columns of parking cubicles.

With reference to FIG. 8, one of the drive sprockets 90 is shown as being deployed outwardly of the framework of the AGV so as to mesh with teeth 94 of one of a pair of vertically extending guide racks 95 that are provided on opposite sides of each of the vertical columns of parking cubicles. As shown in FIG. 9 which is a blow up of the circled area "9" in FIG. 3, each of the vertical guide racks 95 includes a plurality of equally spaced teeth 94 that are disposed between reinforcing flanges 96. The teeth 94 of the guide racks may be recessed relative to the flanges 96 such that guide slots are formed in front of the teeth.

As further shown in FIG. 8, each drive sprocket 90 driven in rotation by an electric or hydraulic motor 97 that drives a drive gear 98 that meshes with the drive sprocket. On-board controllers are used to synchronize the operation of all the motors 97 so that the drive sprockets function together to raise and lower the AGVs 25 relative to the parking cubicles. As further shown in FIG. 8, the drive sprocket and its drive motor are reciprocally carried on a ram 99 of a piston member 100 so that they may be selectively deployed outwardly of the body of the AGV into engagement with the guide racks 95.

As opposed to the deployable drive sprocket assembly described above, a drive sprocket assembly as described in US Published Patent Application 20070065258, U.S. Ser. No. 11/515,380, may be used. The contents of this application are incorporated herein, in there entirety, by reference. The same deploying and drive elements described in the published application may be mounted to a framework defining each of the AGVs of the present invention. Further, the vertical rack or track systems described in the published application may also be used on opposite sides of the vertical columns of parking cubicles of the present invention.

Figure 10:
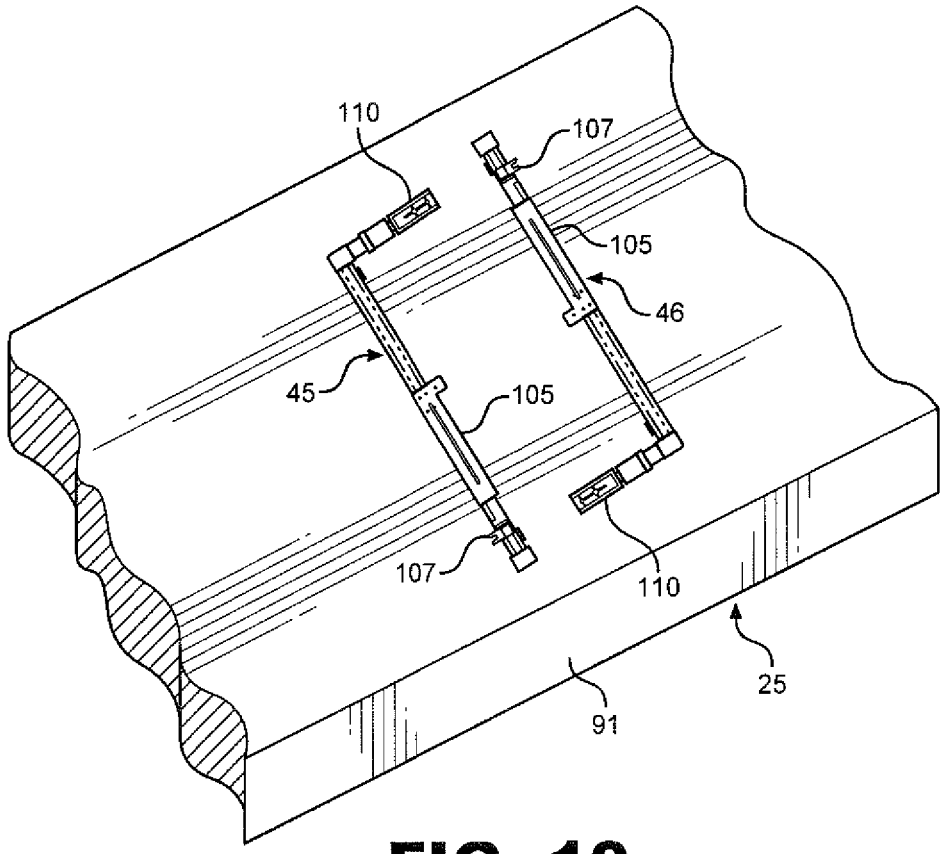
FIG. 10 is an enlarged partial top plan view of the AGV of FIG. 5 showing the two transfer mechanisms for loading and off-loading trays from the AGV.
Figure 11:
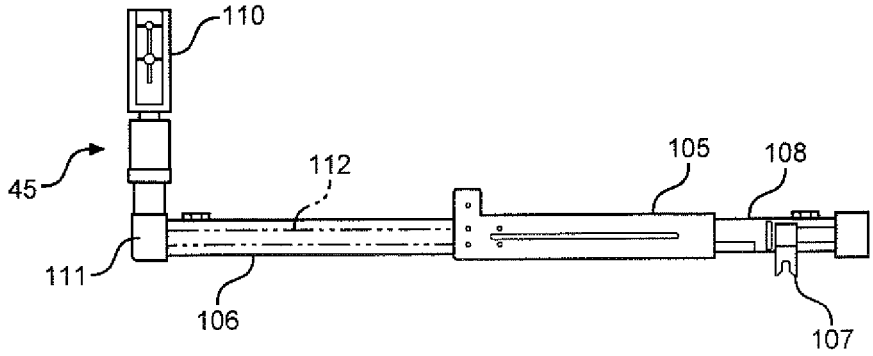
FIG. 11 is an enlarged top plan view of one of the transfer mechanisms of FIG. 10.
Figure 12:
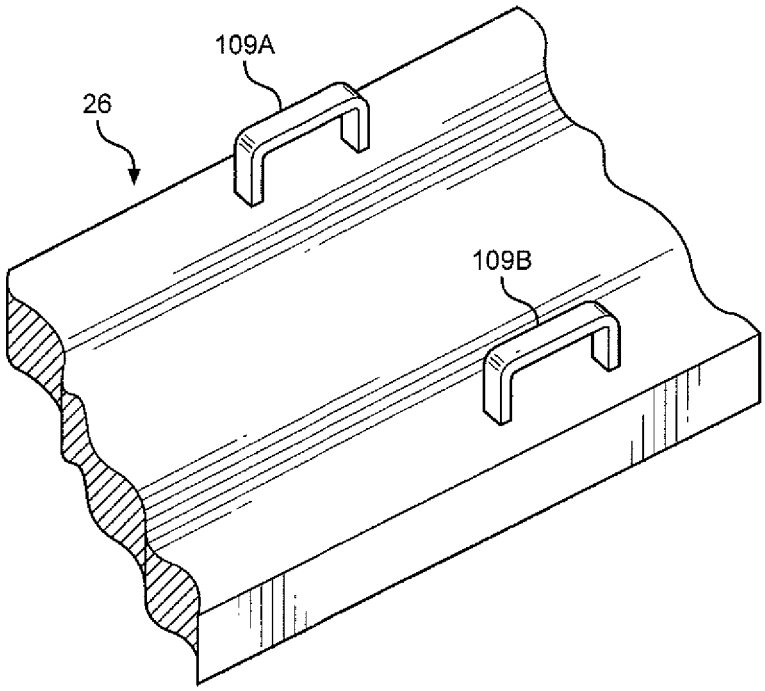
FIG. 12 is a partial bottom view of a one of the support trays of the invention showing a bracket that is engageable by one of the transfer mechanisms of FIG. 10.

With reference to FIG. 10, each AGV 25 has the ability to on-load or off-load from either of opposite sides 91 and 92 thereof. Further, and as shown in FIGS. 10-12, movement of the trays 26 carrying the vehicles "V" relative to an AGV is controlled by transfer mechanisms 45 and 46 mounted to the AGV. FIG. 10 is a partial top plan view of one of the AGVs showing a pair of transfer mechanisms 45 and 46. Transfer mechanisms 45/46 are oppositely oriented but otherwise are identical in structure. The transfer mechanisms are used to extend and retrieve trays and vehicles from the parking cubicles 30 and trays from the tray storage spaces 38 beneath the parking cubicles.

When a tray with a vehicle is to be moved from a storage bin, with an AGV aligned with the appropriate parking cubicle 30, the transfer mechanism 45/46 is activated to deploy a telescoping arm 105 beneath the adjacent tray. With specific reference to FIG. 11, one example of support tray transfer mechanism 45/46 is shown. Each transfer mechanism is designed to be mounted to an AGV 25 and includes a reciprocally movable load engagement arm 105 that is mounted within a guide channel 106 that is secured to the base of the AGV. A somewhat U-shaped catch 107 is pivotally mounted at the free end of the arm 105 and is used to selective engage one of the brackets 109 mounted beneath each support tray, see FIG. 12. Each catch is mounted on an electronic swivel unit 108, that when activated, pivots the catch from a normal low profile position 90° to an upright position, as shown in the drawings.

When a support tray is to be transfer from an AGV from either a parking cubicle 30 or an underlying tray retaining space 38, the catch is rotated in the low profile position as the arm 105 is extended toward a tray 26. When the arm is fully extended, the catch is moved to its upright position wherein the catch will engage the bracket of the tray. Thereafter, the arm 105 is retracted pulling the tray, or tray with vehicle, onto the AGV. The transfer mechanism 45 attaches to the bracket 109A and pulls the tray from the storage cubicle to halfway onto the AGV. Transfer mechanism 46 engages bracket 109B while at the same time transfer mechanism 45 releases the bracket 109A and returns to its home position in a low profile horizontal position. Transfer mechanism 46 pulls the tray fully onto the AGV. The catch 107 remains in engagement with the bracket 109B of the tray to thereby stabilize the tray on the AGV as the AGV descends between the opposing columns of parking cubicles and moves toward an entrance or exit of the parking garage. Movement of the arm 105 is controlled by a reversible motor 110 that has a drive output connected through a gear box 111 to a lead screw 112 disposed within the channel 106. A tray is moved from an AGV into a parking cubicle 30 or storage space 38 in a reverse manner. It should also be noted that the transfer mechanisms may also be of the type described in the previously described published US application.

In some embodiments of the invention, selective parking cubicles may be provided with safety stops that prevent a tray or tray with a vehicle thereon from being off-loaded until an AGV is positioned to receive the tray. Each safety stop forms a elongated vertically raised flange, not shown, that is resiliently and pivotally mounted such that it can only be pivoted inwardly toward the trays but can not be pivot beyond the vertical position to block the opening into a parking cubicles. As a telescoping arm of the transfer mechanism approaches a tray within a storage bin, it will engage and pivot the safety stop to a non-blocking position parallel to the bottom of the tray. The bottom of the tray will retain the safety stop in the non-blocking position until the pallet is pulled free of the parking cubicle 30 or storage space 38, after which, the safety stop automatically returns to its raised blocking position. In like manner, when a tray is being loaded into a parking cubicle 30 or storage space 38, the bottom of the tray 26 will force the safety stop to pivot to its non-blocking position until the tray is fully positioned in place and the telescoping arm is retracted relative to the AGV, at which time, the safety stop automatically pivots upwardly to its blocking position to present accidental displacement of the tray from the parking cubicle or storage space.

Figure 13:
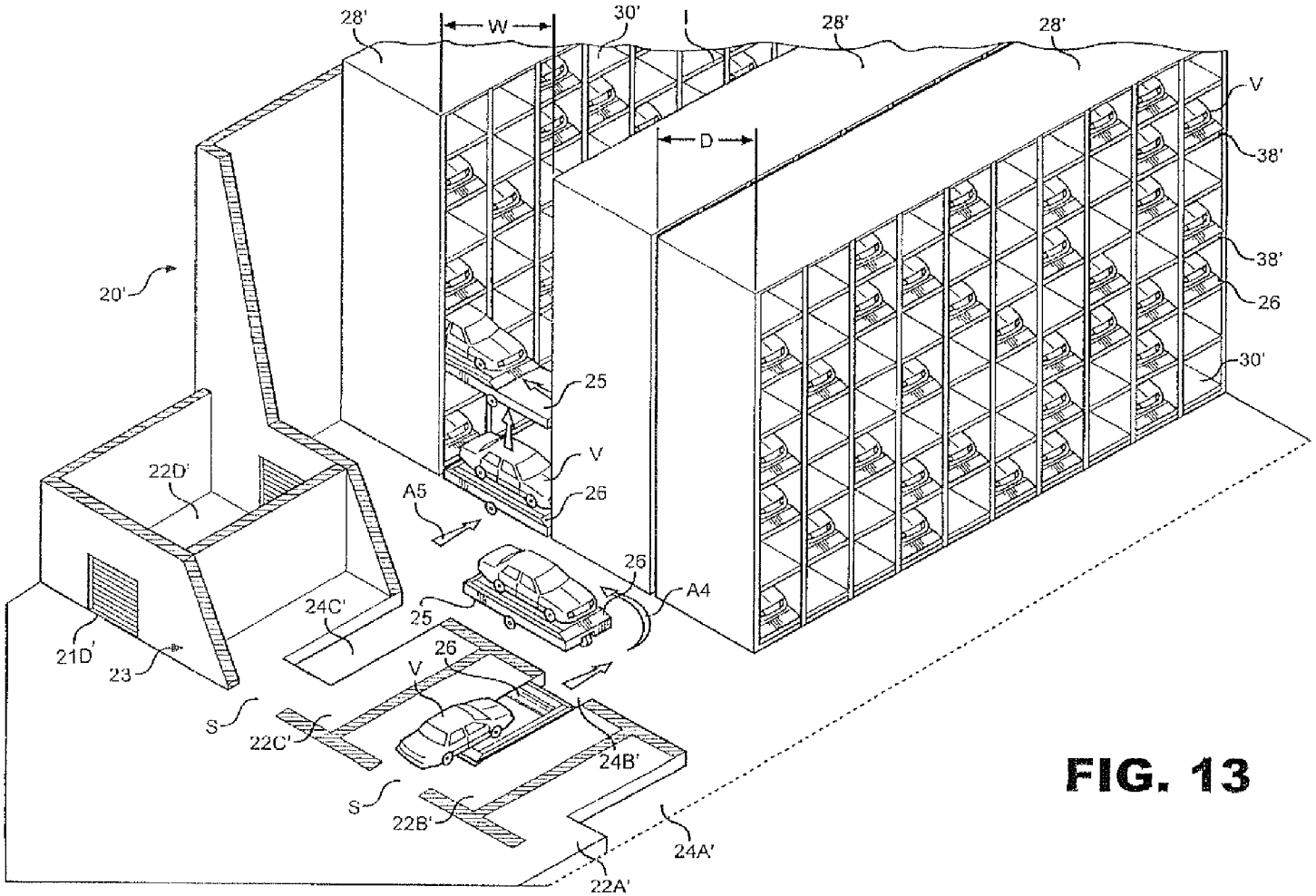
FIG. 13 is a perspective illustration similar to FIG. 3 but showing a second embodiment of the invention wherein the parking cubicles are configured to receive vehicles lengthwise and wherein after the a vehicle is driven onto the tray of an AGV, the AGV is moved in sequence from a loading position adjacent an entry door into the garage, rotated so that the opposite ends of the AGV face the opposing tiers of parking cubicles, moved in an aisle between the tiers of parking cubicles to and is elevated to a position for transferring the vehicle into one of the parking cubicles.
Figure 14:
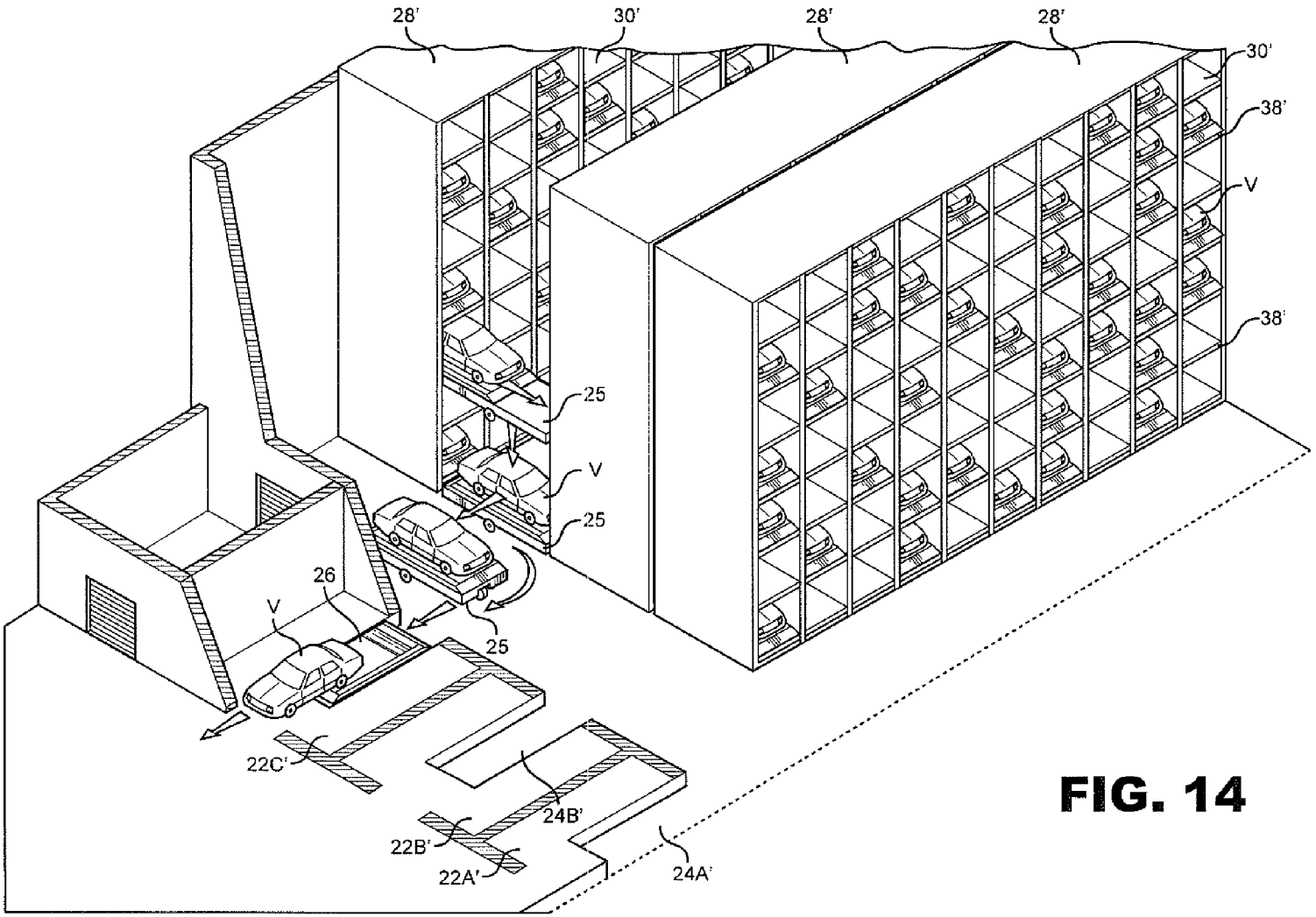
FIG. 14 is a perspective illustration view similar to FIG. 13 but showing the AGVs moving in sequence from a loading position adjacent one of the parking cubicles where a vehicle is loaded onto the tray supported on the AGV, moved to a position aligned with a drive path between the opposing rows of vertical tiers of parking cubicles and is driven horizontally within the garage to an exit of the garage.

With specific reference to FIGS. 13 and 14, a second embodiment of the invention is shown wherein the parking cubicles are configured to receive vehicles lengthwise. In this embodiment a fully automated parking garage system 20' is disclosed that includes a plurality of entrance and/or exit doors, with only exit door 21D' being shown, into spaced loading and off-loading bays 22A'-22D' within a first portion 23' of the system 20'. Within each bay is a recessed docking surface shown at 24A', 24R' and 24C'. The depth of each recessed docking surface is sufficient to allow the AGVs 25, that have been previously described herein, carrying a vehicle support trays 26 to be parked within the docking or loading area such that a conventional automotive vehicle "V" may be directly driven onto the support tray when entering the bay areas of the garage, see FIG. 13, or from the support tray to a travel surface "S" when a vehicle is exiting the garage system, see FIG. 14.

The parking garage includes a plurality of rows 28' of vertical columns of back-to-back parking cubicles 30'. In this embodiment, the aisles "I" between the rows of parking cubicles are created having essentially the same width "W" as the depth "D" of each of the parking cubicles. As with the previous embodiment, the trays 26 on which vehicles are supported are carried by the AGV 25 in such a manner that the AGV maneuvers the vehicle into proper position before the AGV enters an aisle between rows of parking cubicles.

With reference to FIGS. 13 and 14, as a vehicle "V" enters the garage and into bay 22B' wherein an AGV 25 having a vehicle support tray 26 mounted thereon is parked in recessed docking surface area 24B', the vehicle is directly driven onto the tray 26 until the front wheels of the vehicle are received in a somewhat U-shaped cradle 32 that is formed in an upper surface 34 of the tray, see FIGS. 6 and 7. Elongated vertically extending wheel guide flanges 35 and 36 are secured to the upper surface of the tray and are spaced apart a distance to permit the vehicle wheels to be received there between. Although not shown, the outer portions of the flanges 35 and 36 may be flared outwardly so as to function as guide surfaces for properly orienting the steerable front wheels of the vehicle onto the upper surface of the tray. When the front wheels of a vehicle enter the cradle 32, the vehicle is stopped and retained securely within the tray and on the AGV as the wheels can not be easily rolled out of the cradle and the side flanges 35 and 36 prevent any lateral movement of the vehicle relative to the tray 26.

After being loaded onto the tray and AGV, the AGV moves into the parking garage as shown by arrow A4 and the AGV moves laterally as shown by the arrow A5 to align the opposite ends of the AGV with an aisle "I" between opposing rows 28' of vertically tiered parking cubicles 30'. Any orienting of the vehicle "V" such as rotating 180 degrees to position a the vehicle "V" toward the exit direction is performed by the AGV without any other assistance. Thereafter, the AGV enters the row and elevates itself, as has been previously explained, until the vehicle aligns with a particular cubicle 30'. The tray 26 carrying the vehicle is then urged from the AGV into the aligned cubicle.

As with the previous embodiment, additional trays 26 are mounted in some of the spaces 38' below, or above, each parking cubicle. Once a vehicle and supporting tray have been transferred into a parking cubicle, the AGV retrieves the extra tray from the adjacent space 38' and travels back to the loading area at one of the entrances into the garage. If the AGV is directed to retrieve a vehicle from a parking cubicle before it loads another vehicle on the newly loaded tray, the AGV will move to the appropriate parking cubicle and first off-load the tray carried thereon into the empty tray retaining space 38' below the parking cubicle 30'. The space 38' will be vacant as the tray that was previously therein would have been removed by the AGV that initially loaded or transferred the vehicle and tray to be retrieved. As noted in FIG. 13, a height and configuration of each of the tray storage spaces 38' is sufficient to store a vehicle support tray therein and the height is much less than a height of the parking cubicles 30'.

The trays 26 of the second embodiment are loaded and off-loaded in a manner that is similar to that described with respect to the first embodiment with the exception that the tray is moved relative one of the parking cubicles from or to one of the opposite ends 25A and 25B of the AGV, see FIG. 5. The orientation of each of the transfer mechanisms 45 and 46, described with respect to FIG. 10, is moved 90° so that the tray is discharged or retrieved lengthwise of the AGV. The same safety stops may also be provided for the parking cubicles 30' as has been described herein.

When a tray with a vehicle is to be moved from a storage bin, with an AGV aligned with the appropriate parking cubicle 30', the transfer mechanisms are used deploy a telescoping arm, as previously described, beneath the adjacent tray. The tray is engaged and is thereafter pulled on to the AGV.

The drive motors and the vertical drive gears and horizontal drive wheels are the same as described with respect to the first embodiment with the exception of the gears 90 for engaging the track teeth or chain rollers associated chains mounted on opposite side of each of the parking cubicles are mounted at the opposite ends of the AGV and toward the opposite sides thereof.

Figure 15:
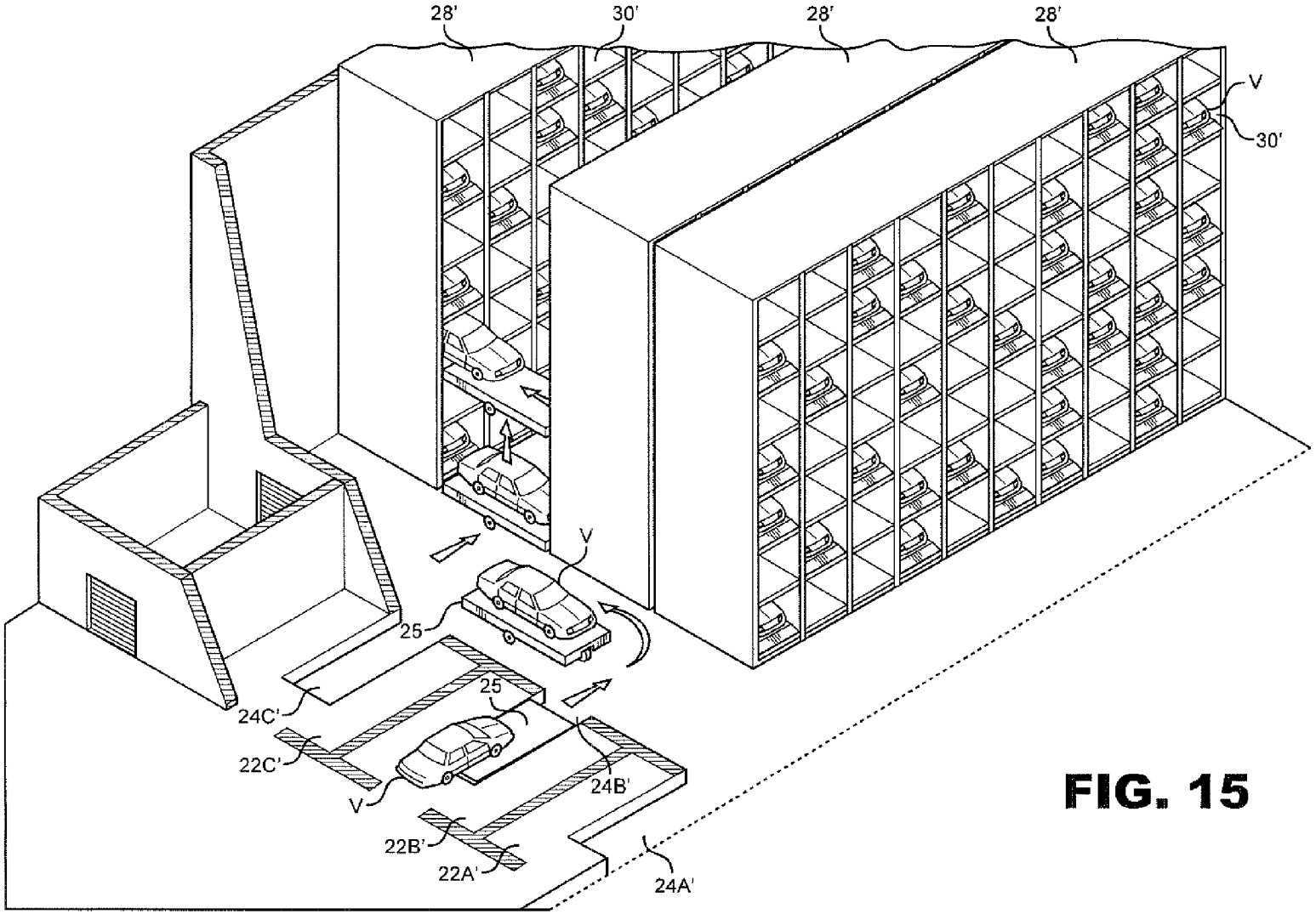
FIG. 15 is a perspective illustration similar to FIG. 13 but showing a variant of the second embodiment of the invention wherein the vehicle is loaded directly onto an upper surface of the AGV, moved into alignment with one of the parking cubicles and is off-loaded lengthwise into one of the parking cubicles.
Figure 16:
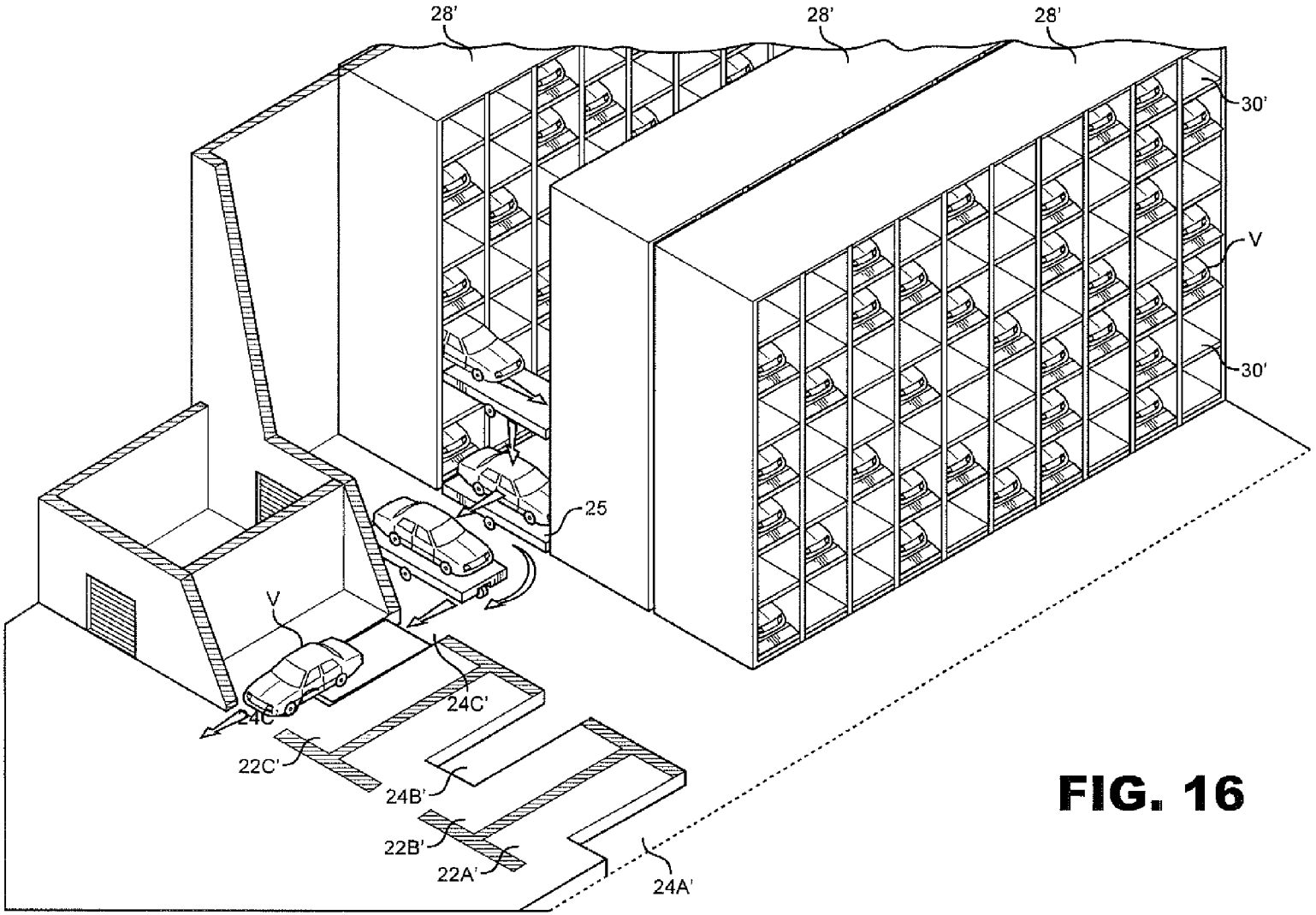
FIG. 16 is a perspective illustration view similar to FIG. 15 but showing the AGV moving in sequence from a loading position adjacent one of the parking cubicles where the vehicle is loaded directly onto the AGV, the AGV is moved to a position aligned with a drive path between the opposing rows of vertical tiers of parking cubicles and is driven horizontally within the garage to an exit of the garage.

With reference to FIGS. 15 and 16, a variant of the second embodiment is shown wherein the vehicles "V" are transported directly on an upper surface of the AGVs. This is possible because the vehicles will be aligned to be driven or rolled directly from the AGVs into or from the parking cubicles 30'. By placing a vehicle in neutral, it may be easily moved into a parking cubicle or pulled there from because the vehicle wheels are aligned to permit such movement. In FIG. 15, a vehicle "V" is shown being pushed into a parking cubicle whereas FIG. 16 shows the vehicle being pulled from the cubicle.

Figure 2:
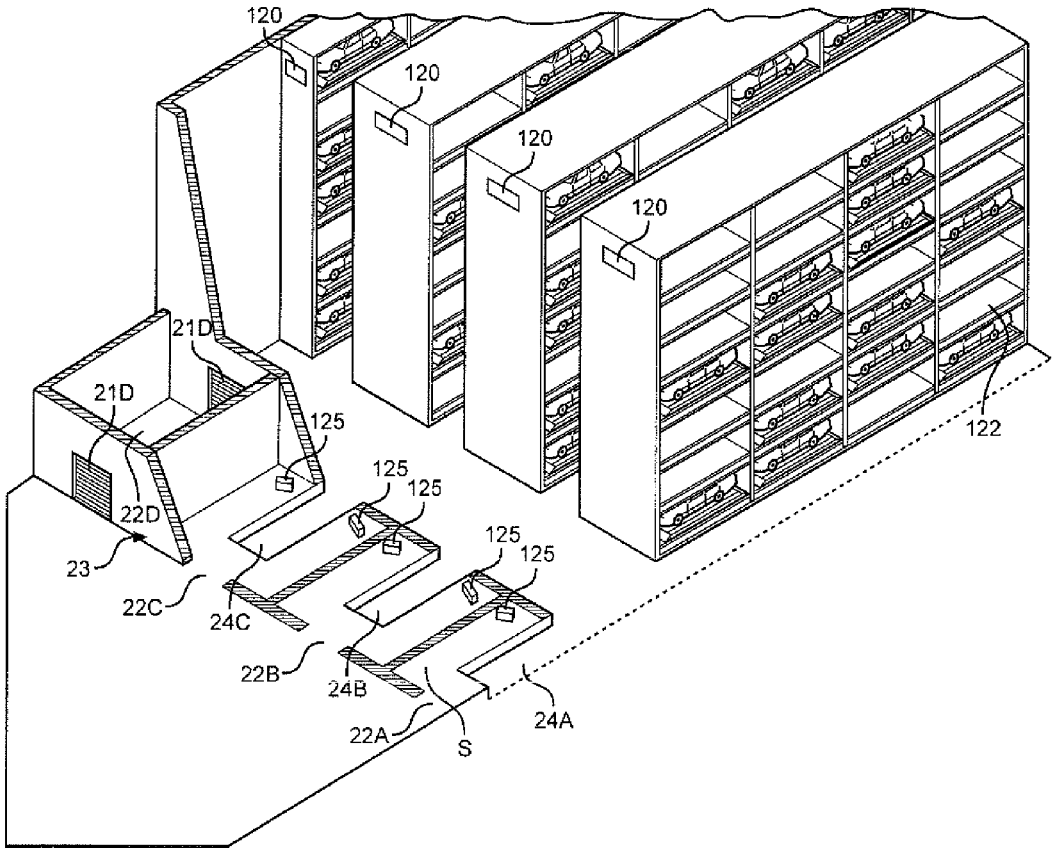
FIG. 2 is a perspective illustrational view of an interior of the parking garage of FIG. 1 with the roof and some wall portions being broken away to show a plurality of rows of vertical columns of parking cubicles that are spaced by a width of one of the parking cubicles with vehicles being parked on trays in many of the parking cubicles and also showing the recessing of the floors of the garage in the areas for receiving and/discharging automotive vehicles relative to transfer vehicles that operate within the garage.

Further, in each of the embodiments of the invention and as shown in FIG. 2, the warehouse storage system may include transponders or RFID scanners 120 for identifying each parking cubicle 30, each AGV 25 and each vehicle support tray 26. Such identification means may include radio frequency identification tags 122 mounted on each tray, AGV and cubicle. In some embodiments bar code scanners, not shown, may be used to read bar code indicia applied to each parking cubicle, AGV and support tray. Using on board sensors, the movement of the AGVs and the position of the various trays may be easily and remotely controlled within the garage. Accordingly, the sensors are able to obtain data from the identification tags or indicia regarding the position of each AGV and tray in the parking garage. The sensors may also transfer information to remote computers for analysis and inventory control.

Figure 17:
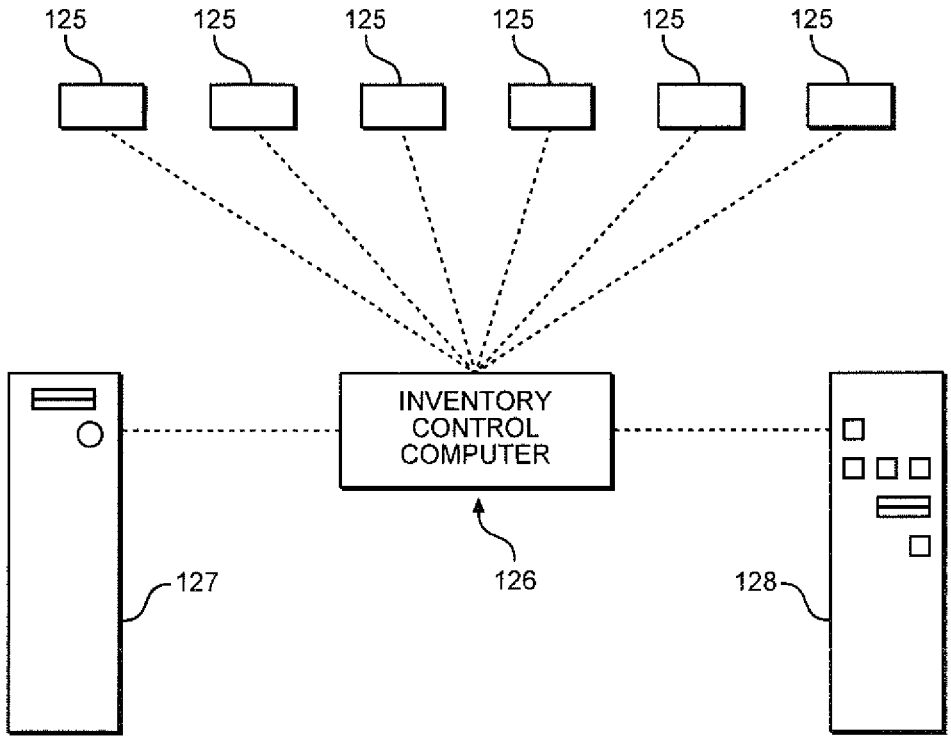
FIG. 17 is a diagram of an accounting, control and payment system in accordance with the invention.

Another feature of the invention is that cameras 125, see FIG. 2, may be used in all of the embodiments of the invention to scan the interior of each vehicle to detect any person still remaining in the vehicle and the license plates of each vehicle entering the garage and each vehicle just prior to leaving the garage. As shown in the diagram of FIG. 17, the cameras are connected to an inventory control computer system 126 that is also connected to a ticket dispenser 127 that issues a ticket receipt or claim check to each vehicle entering the garage and a payment kiosk 128 for receiving payment for parking time before a vehicle is retrieved from a parking cubicle. In this manner, the system ensures that only those vehicles for which payment has been received and for which an authorized release has been obtained by the presentation of the correct ticket receipt may be allowed to exit the garage.

The foregoing description of the present invention has been presented to illustrate the principles of the invention and not to limit the invention to the particular embodiments illustrated. It is intended that the scope of the invention be defined by all of the embodiments encompassed within the following claims and their equivalents.

We claim:

1. A vehicle parking system for automatically parking vehicles and accounting for vehicles within the system, the system comprising a garage structure having a receiving area and a vehicle parking area, the vehicle receiving area including at least one loading area wherein a vehicle is driven onto one of a plurality of automatically guided vehicles that are movable both horizontally and vertically to transport vehicles within the garage structure, the vehicle parking area including a plurality of columns of vertically spaced parking cubicles that are aligned in opposing rows and which are spaced by open spaced aisles, each of the parking cubicles being of at least a first height to receive a tray having a vehicle carried thereon, each automatically guided vehicle having first drive means for driving along horizontal surfaces and second drive means for driving vertically between the opposing rows within the vehicle parking area, each automatically guided vehicle having opposite sides and opposite ends, a plurality of transferable vehicle support trays for being carried on the automatically guided vehicles, each support tray having an upper platform of a size to support a vehicle thereon, transfer means carried by each automatically guided vehicle for selectively transferring a support tray having a vehicle supported thereon from either the opposite sides or opposite ends thereof into or from a parking cubicle, each column of the vertically spaced parking cubicles including a plurality of support tray storage spaces positioned vertically between the parking cubicles, each storage space being of a height which is smaller than the first height so as to cooperatively receive and store a single support tray therein, and wherein a depth of the parking cubicles from front to rear thereof is substantially equal to a width of an aisle between opposing rows of parking cubicles and either a length or width of the at least one automatically guided vehicle.

2. The vehicle parking system of claim 1 wherein the at least one loading area includes at least one recessed docking surface in which an automatically guided vehicle may be positioned to allow a vehicle to be directly driven onto a support tray carried by the automatically guided vehicle.

3. The vehicle parking system of claim 1 including a pair of vertically oriented guide racks or chains extending on opposite sides of each column of vertically spaced parking cubicles so as to be aligned with opposing vertically oriented guide racks or chains on opposite sides of opposing columns of vertically spaced parking cubicles, wherein each of the vertical racks or chains is formed having generally equally spaced teeth and the drive elements are rotatable drive elements having teeth that cooperatively mesh with the teeth of the racks or chains.

4. The vehicle parking system of claim 3 wherein the second drive means including drive elements for engaging the guide racks or chains that extend vertically in opposing relationship with one another on opposite sides of each of the columns of vertically spaced parking cubicles, the drive elements being extendable from either the opposite sides or opposite ends of each automatically guided vehicle so as to be engaged with two pairs of the opposing vertically oriented guide racks or chains when the automatically guided vehicles are positioned between two opposing columns of vertically spaced parking cubicles, and deployment means mounted on each automatically guided vehicle for selectively deploying the drive elements from the opposite sides or ends of each automatically guided vehicle to engage with the racks or chains and for selectively withdrawing the drive elements from engagement with the racks or chains.

5. The vehicle parking system of claim 1 including retention means for retaining a vehicle in position on a support tray as the vehicle is moved by an automatically guided vehicle.

6. The vehicle parking system of claim 5 wherein each automatically guided vehicle includes means for securely engaging the vehicle support tray thereto.

7. The vehicle parking system of claim 5 wherein the retention means includes at least one concave wheel receiving well formed along an upper portion of each support tray and a pair of spaced and upwardly oriented side flanges mounted to each support tray so as to prevent a vehicle from moving laterally with respect to the upper portion of the support tray.

8. The vehicle parking system of claim 1 including controlling means for automatically electronically controlling movement of the plurality of automatically guided vehicles, the controlling means including electronic means for identifying a parking cubicle and activating means for activating the automatically guided vehicles to appropriately store or retrieve vehicles on the support trays relative to a predetermined parking cubicle.

9. The vehicle parking system of claim 1 wherein a support tray storage space is provided adjacent and below or above each parking cubicle.

10. The vehicle parking system of claim 1 wherein each support tray is supported on roller means and includes a pair of spaced retention flanges extending from an upper surface thereof which are spaced apart a distance greater than a width of a vehicle to be supported on the support tray.

11. The vehicle parking system of claim 1 wherein a number of support trays is equal to a number of parking cubicles plus a number of the plurality of automatically guided vehicles in the parking system.

12. The vehicle parking system of claim 11 including controlling means for automatically electronically controlling movement of each automatically guided vehicle, the controlling means including electronic means for identifying predetermined parking cubicles and activating means for activating the automatically guided vehicles to appropriately store or retrieve vehicles relative to the predetermined parking cubicles.

* * * * *